US009181963B2

(12) United States Patent
Naitou

(10) Patent No.: US 9,181,963 B2
(45) Date of Patent: Nov. 10, 2015

(54) OPERATION LEVER LOCK APPARATUS

(75) Inventor: Shinobu Naitou, Yuki (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/698,101

(22) PCT Filed: Jan. 23, 2012

(86) PCT No.: PCT/JP2012/051346

§ 371 (c)(1),
(2), (4) Date: Nov. 15, 2012

(87) PCT Pub. No.: WO2013/061620

PCT Pub. Date: May 2, 2013

(65) Prior Publication Data

US 2014/0230936 A1 Aug. 21, 2014

(30) Foreign Application Priority Data

Oct. 28, 2011 (JP) ..... 2011-236972

(51) Int. Cl.
*B66F 9/20* (2006.01)
*F15B 13/01* (2006.01)
(Continued)

(52) U.S. Cl.
CPC ..... *F15B 13/01* (2013.01); *B66F 9/07504* (2013.01); *B66F 9/20* (2013.01); *E02F 9/2004* (2013.01); *Y10T 137/877* (2015.04)

(58) Field of Classification Search
CPC ..... B66F 9/07504; B66F 9/20; E02F 3/26; E02F 9/20; E02F 9/2004; E02F 9/2012
USPC ..... 137/351, 353, 354, 637, 899; 251/89, 251/90; 74/491
See application file for complete search history.

(56) References Cited

U.S. PATENT DOCUMENTS 4,706,776 A * 11/1987 Hyoki et al. ..... 180/334
4,778,205 A * 10/1988 Sayre ..... 292/171
(Continued)

FOREIGN PATENT DOCUMENTS

JP 61-75498 U 5/1986
JP 61-86398 U 6/1986
(Continued)

OTHER PUBLICATIONS

International Search Report dated May 1, 2012, issued for PCT/JP2012/051346 (in Japanese langauage).

*Primary Examiner* — Kevin Murphy
(74) *Attorney, Agent, or Firm* — Locke Lord LLP

(57) ABSTRACT

An operation lever lock apparatus includes: operation levers; hydraulic control valves arranged at a portion lower than a floor panel; and link members, each of the link members extending downward from a base part of a corresponding one of the operation levers to be connected to a corresponding one of the hydraulic control valves, wherein the hydraulic control valves are operated by causing the link members to move vertically, the apparatus further including: an engagement member provided under the link member; and a stopper member having an engagement part to be engaged in the engagement member, wherein the stopper member is movable between an engaged position at which the engagement part engages in the engagement member and a released position at which the engagement part is released from the engagement member, and arranged to restrict movement of the link member in a vertical direction when positioned in the engaged position.

6 Claims, 6 Drawing Sheets

(51) Int. Cl.
*B66F 9/075* (2006.01)
*E02F 9/20* (2006.01)

(56) References Cited

U.S. PATENT DOCUMENTS 5,446,982 A * 9/1995 Blaszynski ..... 37/396
6,557,586 B1 * 5/2003 Lockyer et al. ..... 137/637
7,617,620 B2 * 11/2009 Fukudome et al. ..... 37/442
2007/0221010 A1 * 9/2007 Hanson et al. ..... 74/519

FOREIGN PATENT DOCUMENTS

JP 6-56097 U 8/1994
JP 09-086897 A 3/1997
JP 09-216798 A 8/1997
JP 11-106196 4/1999
JP 2010-168204 A 8/2010

* cited by examiner

OPERATION LEVER LOCK APPARATUS

FIELD

The present invention relates to an apparatus for locking operation levers used for loading and unloading operation in a forklift.

BACKGROUND

Forklifts serving the loading and unloading operation are provided with a plurality of hydraulic cylinders in order to hoist a fork with respect to a mast, in order to move the fork laterally with respect to the mast, or in order to change a tilt angle of the mast with respect to the vehicle. These hydraulic cylinders allows the operator to make operation at will by operating a plurality of operation levers provided on the dashboard to cause the hydraulic control valve to be switched and control the oil supply.

Typically, this type of forklift is provided with a mechanism for locking the operation levers in order to prevent the fork from moving unintentionally. For example, in Patent Literature 1, a lever lock apparatus is arranged on the upper surface of an upper panel of a dashboard, and a slider of the lever lock apparatus is linked to the operation lever by a link. The slider is provided with a hole, into which a pin of the lever lock apparatus can be inserted. In the lever lock apparatus arranged as mentioned above, the movement of the slider is restricted, so that the movement of the operation lever linked via the link is also restricted. Therefore, the unintended movement of the operation lever can be prevented. When the operation lever is operated, magnetization of the solenoid connected to the pin causes the pin to be pulled out from the hole of the slider, so that the slider is able to move allowing for the operation of the operation lever.

CITATION LIST

Patent Literature

Patent Literature 1: Japanese Laid-open Patent Publication No. 9-86897

SUMMARY

Technical Problem

The arrangement disclosed in Patent Literature 1, however, it will be difficult to link the lover lock apparatus to the operating end part of the operation lever unless the lever lock apparatus is provided close to the dashboard. Therefore, the forward visibility is likely to be blocked by the lever lock apparatus. Even if the lever lock apparatus were accommodated inside the dashboard, this requires the change in the position of the upper panel of the dashboard, and thus it is still difficult to improve the forward visibility. In particular, since forklifts are often provided with a plurality of operation levers, the problem as described above will be further notable in the arrangement disclosed in Patent Literature 1 that requires individual lever lock apparatus for each operation lever.

Considering the above situation, the present invention intends to provide an operation lever lock apparatus that can ensure to prevent the unintended movement of the fork without obstructing the forward visibility.

Solution to Problem

To overcome the problems and achieve the object, according to the present invention, an operation lever lock apparatus applied to a forklift, the apparatus comprises: a plurality of operation levers arranged rotatably with respect to a common lever rotation axis which is provided in a position covered with a dashboard and is arranged in a lateral direction of a vehicle; a plurality of hydraulic control valves which are arranged at a portion lower than a floor panel in a front part of the vehicle and are arranged in parallel in the lateral direction, the plurality of hydraulic control valves having valve input parts on upper surfaces of the hydraulic control valves, respectively; and a plurality of link members, each of the plurality of link members extending downward from an operation base part of a corresponding one of the operation levers to be connected to a corresponding one of the valve input parts, wherein the hydraulic control valves are operated via the valve input parts by causing the link members to move vertically via operation parts of the operation levers, the apparatus further comprises: an engagement member provided under the link member; and a stopper member having an engagement part to be engaged in the engagement member, wherein the stopper member is movable between an engaged position at which the engagement part engages in the engagement member and a released position at which the engagement part is released from the engagement member, and arranged to restrict movement of the link member in a vertical direction when positioned in the engaged position.

According to the present invention, the stopper member has a plate-like shape and has a plurality of the engagement parts that, when positioned in the engaged position, engage in a plurality of the engagement members, respectively, to restrict movements of the link members in the vertical direction.

According to the present invention, an actuator is supported by a bracket body in which the stopper member is movably arranged, the actuator is driven to move the stopper member between the engaged position and the released position, and the stopper member and the actuator are attached to the vehicle via the bracket body.

According to the present invention, the engagement member has an engagement shaft part having a size that allows the engagement part of the stopper member to engage therein, and large diameter engagement base parts respectively provided at upper and lower ends of the engagement shaft part and, when the stopper member is positioned in the engaged position, movement of the link member in the vertical direction is restricted by causing two contact end surfaces each of which is formed between the engagement shaft part and the engagement base part to come into contact with the stopper member.

According to the present invention, each of the engagement base parts of the engagement member has a taper part whose outer diameter gradually decreases as approaching the engagement shaft part.

According to the present invention, the operation lever lock apparatus further comprises a bias member to always bias the stopper member towards the engaged position, and the actuator is provided to cause the stopper member to move to the released position against a force of the bias member.

Advantageous Effects of Invention

According to the present invention, the engagement member is arranged to the link member extending downward from the operation base part of the operation lever and the stopper member is engaged in the engagement member to restrict the movement of the operation lever through the link member, so that it is not required to arrange a large part around the dashboard. Further, although it is necessary to provide respective link members for a plurality of operation levers, the stopper member can be shared, so that the number of the parts can be significantly reduced even in the forklift comprising a plurality of operation levers, and thus a good forward visibility can be ensured.

BRIEF DESCRIPTION OF DRAWINGS

FIG. 6-1 is a plane view of an engaged position, viewed from a floor panel, where the engagement members and the stopper member are engaged in the loading and unloading operation unit of FIG. 1.

FIG. 6-2 is a plane view of a released position, viewed from a floor panel, where the engagement of the engagement members and the stopper member is released in the loading and unloading operation unit of FIG. 1.

DESCRIPTION OF EMBODIMENTS

Hereafter, by referring to the attached drawings, a preferred embodiment of an operation lever lock apparatus of the present invention will be described in detail.

Figure 1:
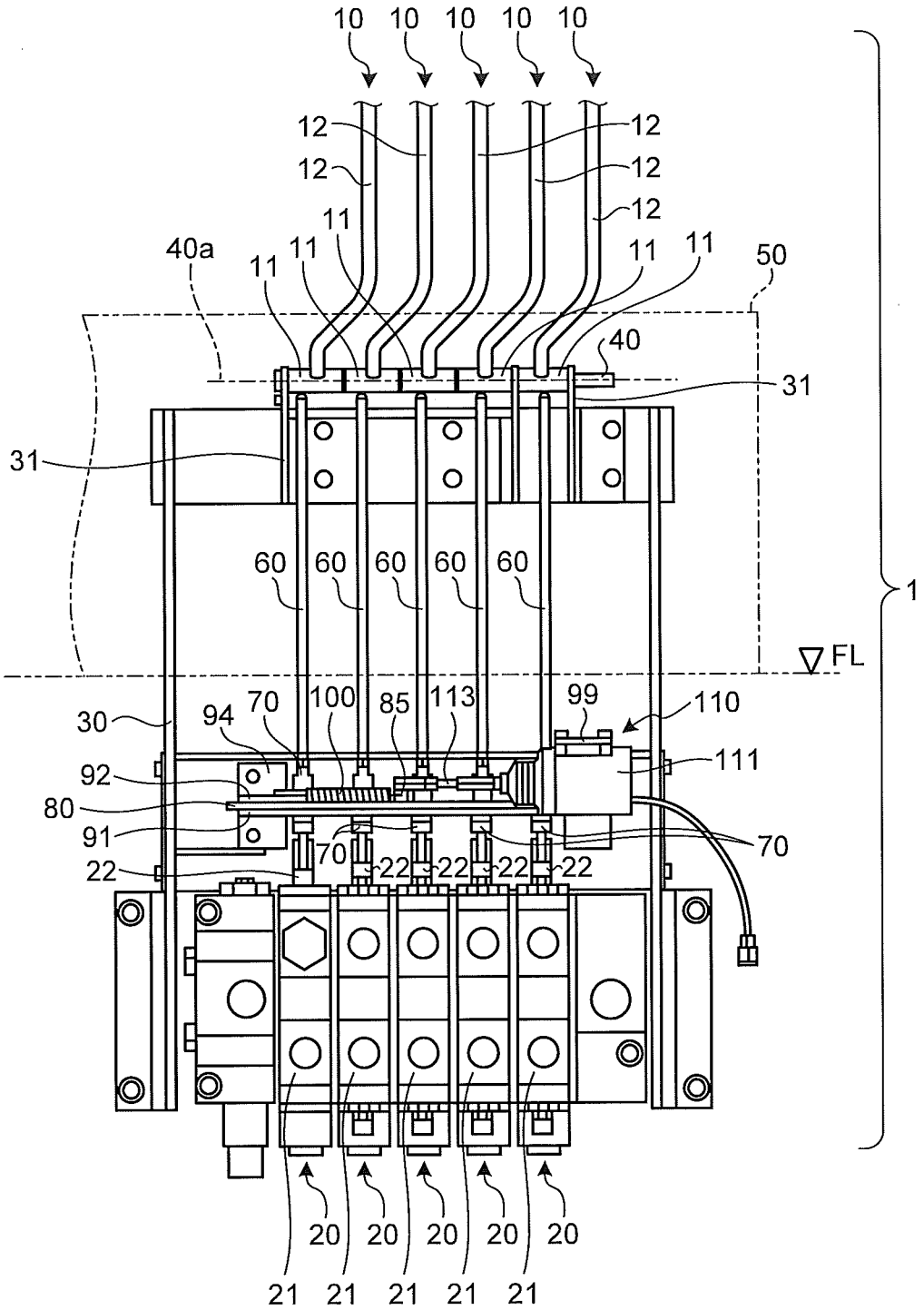
FIG. 1 is a view of a loading and unloading operation unit, viewed from a rear side of a vehicle, to which an operation lever lock apparatus of an embodiment of the present invention is applied.
Figure 2:
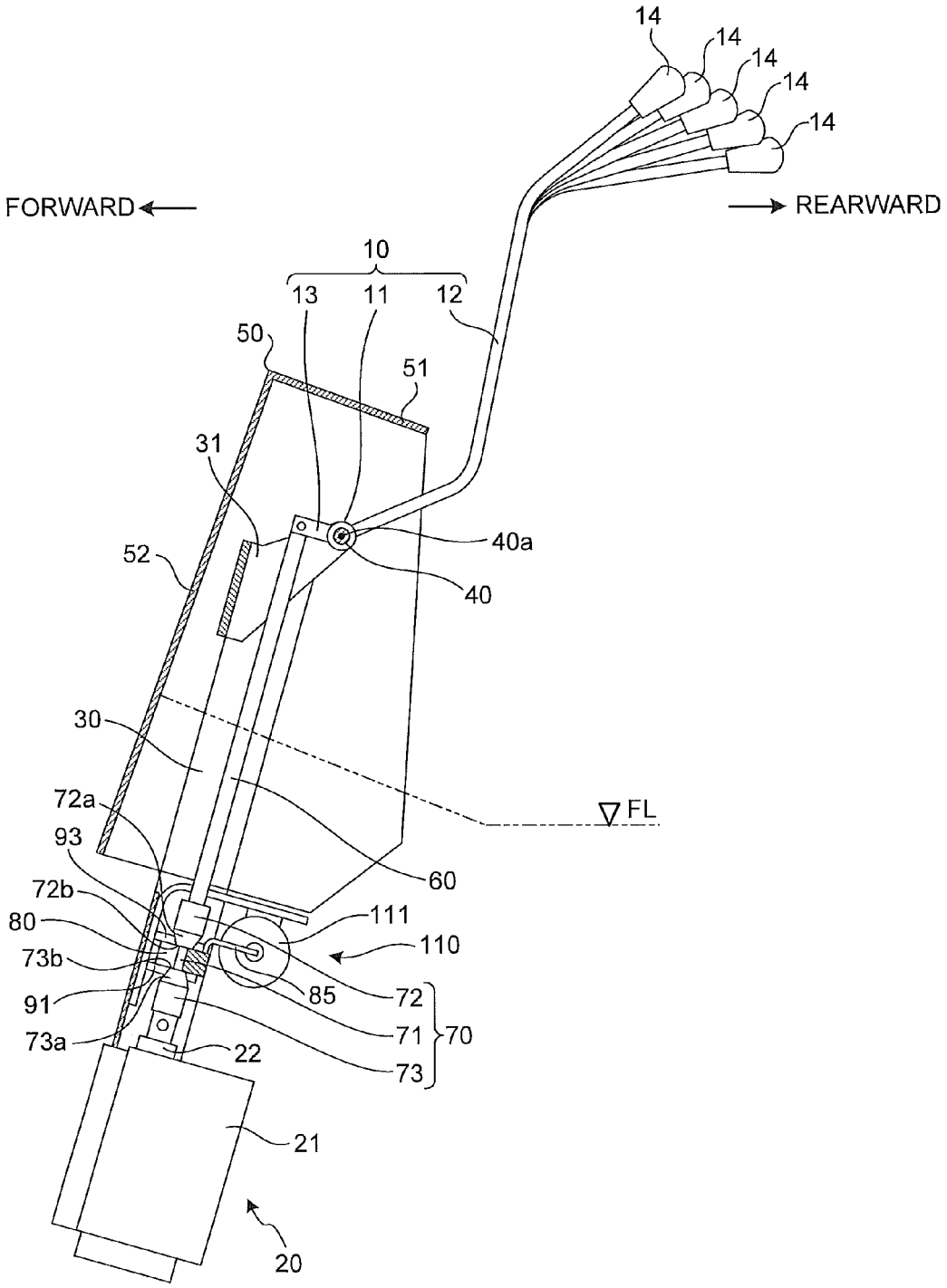
FIG. 2 is a cross-sectional side view of the loading and unloading operation unit of FIG. 1.
Figure 3:
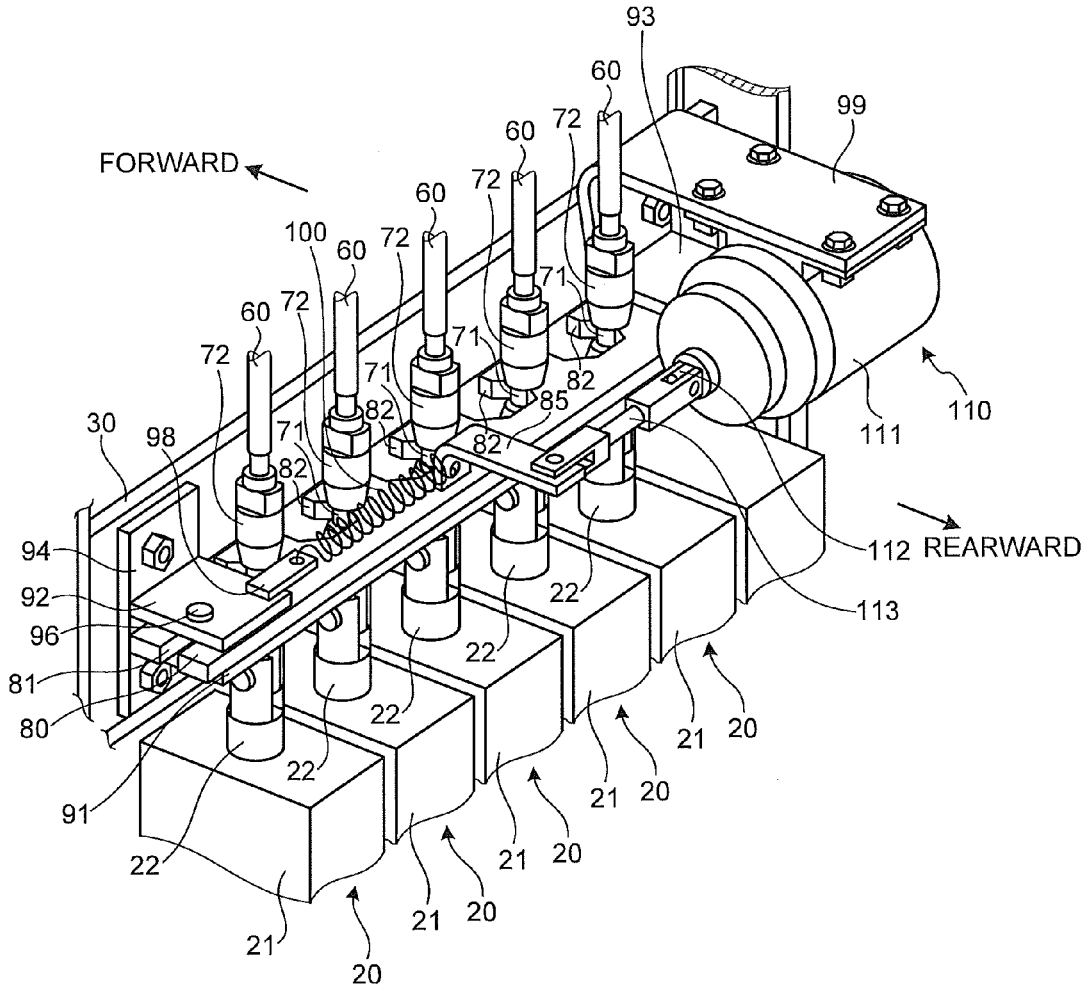
FIG. 3 is a perspective view of a main part of the loading and unloading operation unit of FIG. 1.

FIGS. 1 and 2 illustrate main parts of a forklift to which the operation lever lock apparatus of the embodiment of the present invention is applied. The forklift exemplified here comprises a plurality of operation levers 10 and a plurality of hydraulic control valves 20 to configure a loading and unloading operation unit 1, and the desired loading and unloading operation can be made when the hydraulic control valves 20 are switched by the operation of the operation levers 10 to cause the corresponding hydraulic cylinders (not illustrated) to properly expand and contract. Although not illustrated, the forklift exemplified in the present embodiment comprises a mast provided to the front end of the vehicle, a backrest arranged movably to the mast, and a pair of forks arranged movably in the lateral direction to the backrest.

This forklift is provided with a first hydraulic cylinder for causing the backrest to move upward and downward with respect to the mast, a second hydraulic cylinder for causing the mast to tilt in back and forth with respect to the vehicle, a third hydraulic cylinder for causing the backrest to move laterally with respect to the mast, and a fourth hydraulic cylinder and a fifth hydraulic cylinder for causing the pair of forks to move laterally, respectively, in a separate manner with respect to the backrest. The loading and unloading operation unit 1 for controlling these five hydraulic cylinders comprises five hydraulic control valves 20 for the oil supply control and comprises five operation levers 10 for operating respective hydraulic control valves 20. These operation levers 10 and hydraulic control valves 20 are supported by a unit support 30 to configure the loading and unloading operation unit 1 as described above.

Each of the operation lever 10 comprises an operation base part 11 having a cylindrical shape, an operation part 12 extending outward from the outer surface of the operation base part 11, and an output part 13. A support shaft member 40 is inserted into a center hole of the operation base parts 11, and these operation levers 10 are arranged in parallel to each other rotatably with respect to the axis (rotation axis of the levers) 40*a* of the support shaft member 40. The support shaft member 40 is supported at its both ends by support members 31 provided on the upper end of the unit support 30 and, at the position above the floor panel FL and covered by a top plate 51 and a front plate 52 of a dashboard 50 provided to the front part of the vehicle, is disposed substantially horizontally in the lateral direction of the vehicle.

The operation parts 12 of the operation levers 10 extend rearward of the vehicle from respective operation base parts 11 gradually inclining upward, then bend upward and protrude over the top plate 51 of the dashboard 50, and further bend rearward of the vehicle. The protruding end of the operation part 12 is provided with a grip 14 for the operator to grasp.

The output parts 13 of the operation levers 10 protrude in the same pitch each other to the forward of the vehicle from respective operation base parts 11 and each supports a link member 60 at each protruding end. The link members 60 is a rod-like member whose lateral cross section is a circle and the axis extends straight, and each lower end penetrates the floor panel FL to reach thereunder. Each upper end of the link member 60 is connected to the output part 13 of the operation lever 10 rotatably with respect to the axis extending substantially horizontally along the lateral direction of the vehicle.

The hydraulic control valve 20 comprises a rectangular parallelepiped valve body 21, and one end surface of each valve body 21 comprises a valve input part 22. Although not depicted, the valve input part 22 is an operation input part for causing a spool disposed inside the valve body 21 to be switched from the outside of the valve body 21, and functions to switch the oil supply direction with respect to the corresponding hydraulic cylinder (not illustrated) when moving back and forth with respect to the valve body 21. It is noted that, although not explicitly depicted, the hydraulic control valve 20 applied in the present embodiment incorporates a neutral spring for causing the spool to return to the neutral state, and operates so as to return to the neutral position in response to the removal of the operation force that has been added to the operation lever 10.

These hydraulic control valves 20 are supported at the unit support 30 with the valve input parts 22 directed upward and the valve input parts 22 aligned in a line along the lateral direction of the vehicle. As illustrated in FIG. 2, the position where the hydraulic control valves 20 are disposed is under the floor panel FL.

Figure 5:
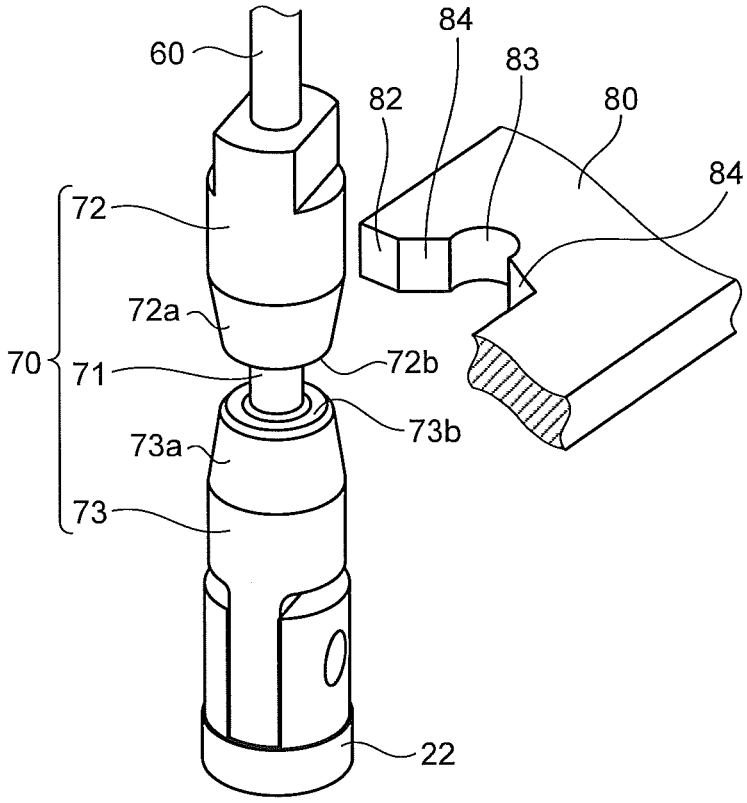
FIG. 5 is an enlarged perspective view illustrating a relationship of engagement members provided to link members and a stopper member.

Each valve input part 22 is connected with the lower end of the link member 60 via an engagement member 70. As illustrated in FIGS. 1 and 5, the engagement member 70 has an engagement shaft part 71 having a cylindrical shape with substantially the same outer diameter as that of the link member 60, and engagement base parts 72 and 73 with a larger diameter provided to both upper and lower ends of the engagement shaft part 71. This engagement member 70 is connected to the valve input part 22 of the hydraulic control valve 20 via the lower engagement base part 73 and connected to the lower end of the link member 60 via the upper engagement base part 72. Two engagement base parts 72 and 73 of the engagement member 70 are formed with taper parts 72*a* and 73*a* whose outer diameter gradually decreases as the end closer to the engagement shaft part 71 approaches to the engagement shaft part 71. Further, the engagement shaft part 71 and the two upper and lower engagement base parts 72 and 73 are arranged coaxially each other, and comprise two contact end surfaces 72*b* and 73*b* between the engagement shaft part 71 and each of the engagement base parts 72 and 73. The contact end surfaces 72*b* and 73*b* are planes extending annually around the engagement shaft part 71 and crossing orthogonally to the axis of the engagement base parts 72 and 73, respectively, and are provided in parallel to each other.

As illustrated in FIG. 1, the valve input parts 22 of the hydraulic control valves 20 are aligned in parallel in the same pitch as that of the output parts 13 of the operation levers 10. Therefore, the link members 60 connecting these valve input parts 22 of the hydraulic control valves 20 with the output parts 13 of the operation levers 10 are arranged in parallel in the same pitch to each other.

On the other hand, in this forklift, a stopper plate (stopper member) 80 is disposed at the position under the floor panel FL. As illustrated in FIGS. 1, 3, 4, 6-1 and 6-2, the stopper plate 80 has a longer length than the total size along the lateral direction of the five hydraulic control valves 20 provided in parallel, and is a plate-like shape having a slightly smaller thickness than the gap between the two contact end surfaces 72*b* and 73*b* provided to the engagement member 70. Both ends of the stopper plate 80 are formed with guide grooves 81, each of which extends in the longitudinal direction and is open to corresponding short edge. This stopper plate 80 is supported by the unit support 30 via a bracket body 90.

Figure 4:
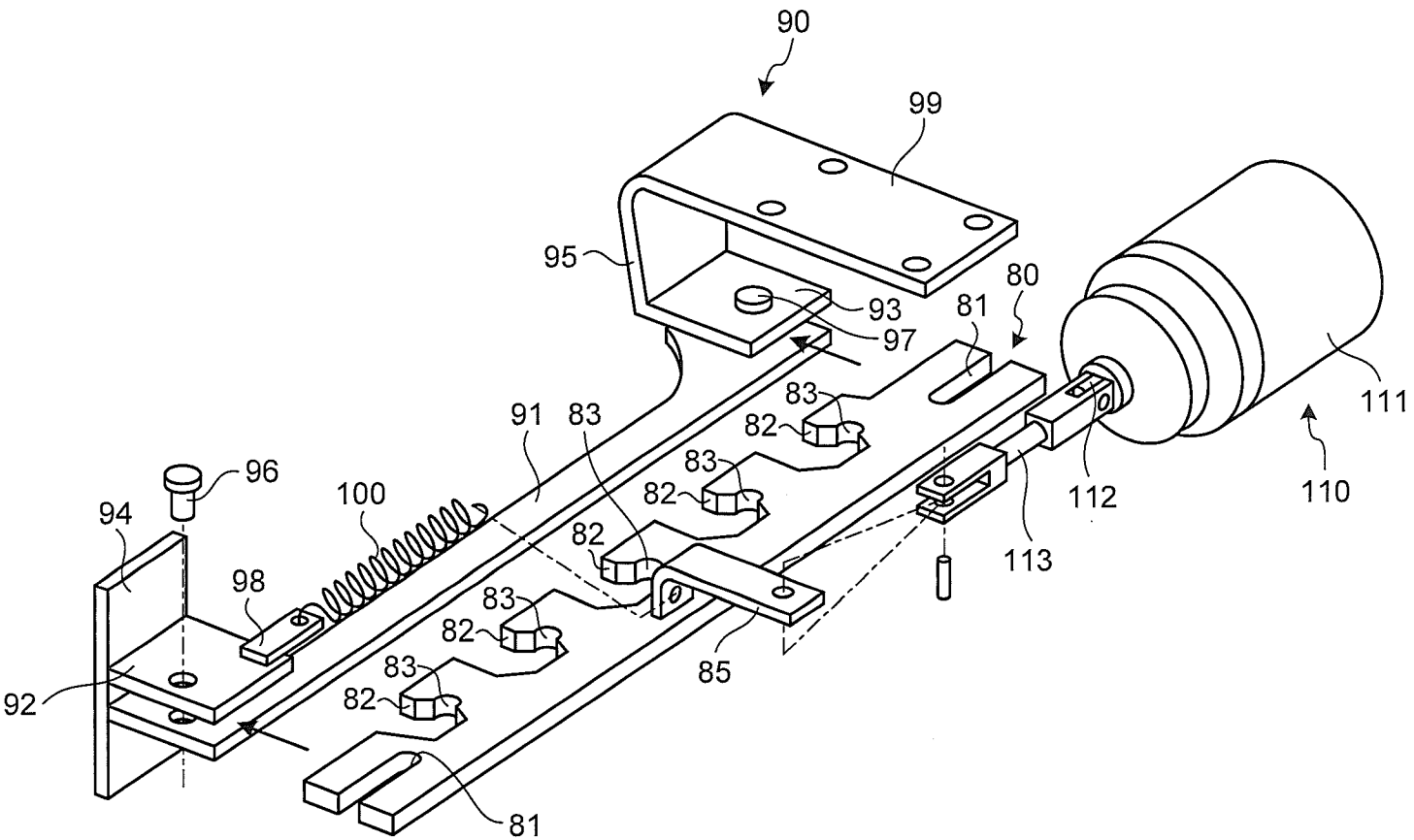
FIG. 4 is an exploded perspective view of a main part of the loading and unloading operation unit of FIG. 1.

The bracket body 90 as illustrated in FIG. 4 comprises a reference plate 91 having substantially the same length as the stopper plate 80, a pair of guide plates 92 and 93 disposed in a manner facing to both ends of the reference plate 91, a connection plate 94 for connecting the reference plate 91 to the guide plate 92, a connection plate 95 for connecting the reference plate 91 to the guide plate 93, a guide pin 96 provided between the guide plate 92 and the reference plate 91, and a guide pin 97 provided between the guide plate 93 and the reference plate 91. This bracket body 90 is attached to the unit support 30 via the connection plates 94 and 95 such that the reference plate 91 covers the hydraulic control valves 20 and that the position of the gap between the reference plate 91 and the guide plates 92 and 93 corresponds to the engagement shaft parts 71 of the engagement members 70.

Figures 1, 6:
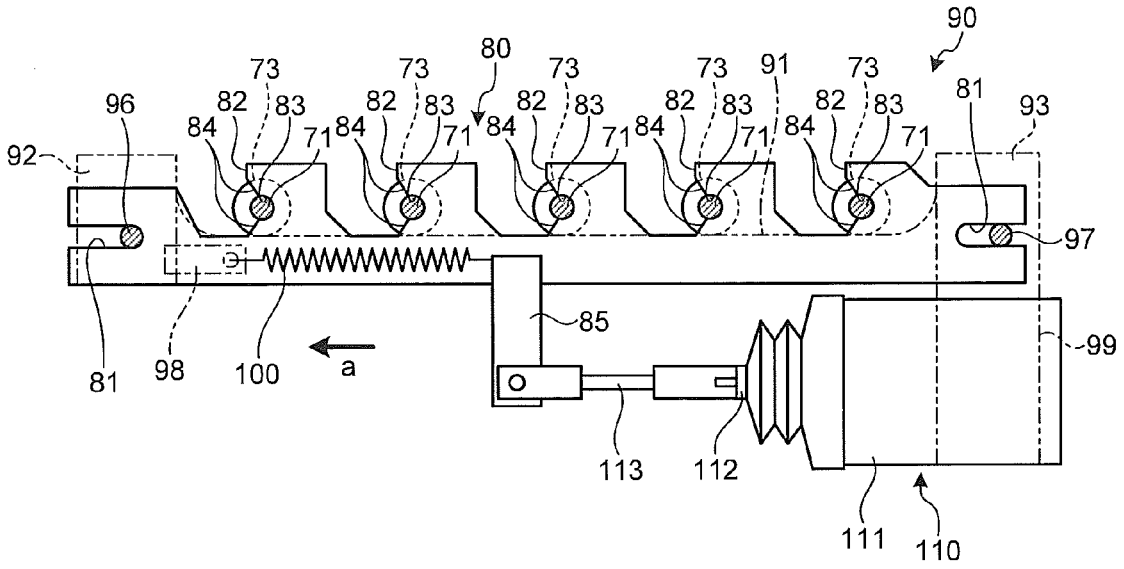
Figures 2, 6:
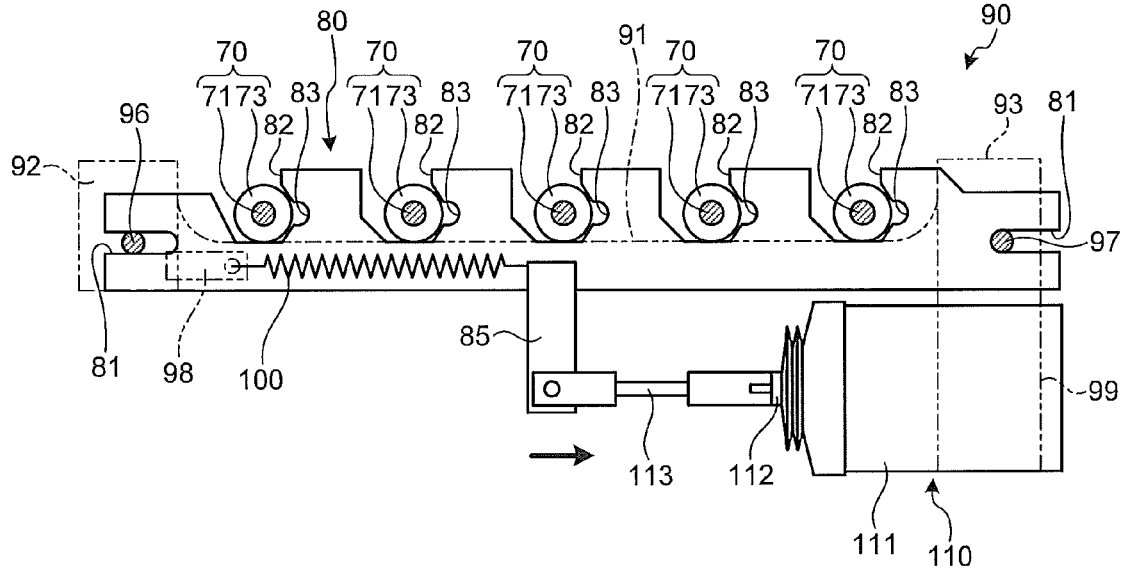

Both ends of the stopper plate 80 are interposed between the reference plate 91 and the guide plates 92 and 93 with the guide pins 96 and 97 inserted into the guide grooves 81 of the stopper plate 80 at both ends, respectively, so that the stopper plate 80 is restricted to move in the thickness direction of the plate with respect to the bracket body 90, while is able to move in the longitudinal direction in response that the guide pins 96 and 97 move inside the guide grooves 81. As illustrated in FIGS. 6-1 and 6-2, the reference plate 91 of the bracket body 90 is arranged to have a narrow part positioned between the guide plates 92 and 93 so that the stopper plate 80 can directly face each of the valve input parts 22 of the hydraulic control valves 20.

In the stopper plate 80, the part corresponding to each valve input part 22 of the hydraulic control valve 20 is provided with each releasing notch 82. The releasing notch 82 is a notch that is open to one side of the edges of the stopper plate 80 and has a size allowing the engagement base parts 72 and 73 of the engagement member 70 to be inserted therein. Corresponding engagement shaft parts 71 of the engagement members 70 are disposed at respective releasing notches 82. The releasing notches 82 of the stopper plate 80 are formed with respective engagement parts 83 positioned in a line along the longitudinal direction. The engagement part 83 is substantially the semicircle recess formed in a size that allows the engagement shaft part 71 of the engagement member 70 to be inserted therein. These engagement parts 83 all open to one of the shorter edges of the stopper plate 80 (to the left in FIG. 6-2), and are formed ensuring the same distance between each other as the pitch of the link members 60. As apparent from the drawings, both sides of the engagement part 83 is formed with a pair of inclined guide surfaces 84, respectively. The pair of inclined guide surfaces 84 are planes formed such that the distance between each other gradually increases as the distance from the engagement part 83 increases.

The bracket body 90 is provided with a tension spring (bias member) 100 and an electromagnetic solenoid (actuator) 110. The tension spring 100 is interposed between a spring holding piece 98 provided to one guide plate 92 of the bracket body 90 and a spring holding part 85 provided to the stopper plate 80, and always biases the stopper plate 80 in one direction with respect to the bracket body 90. The bias direction of the tension spring 100 is the direction in which the distance between the opening of the engagement part 83 formed to the stopper plate 80 and the guide plate 92 facing thereto decreases, as illustrated by the arrow a in FIG. 6-1.

The electromagnetic solenoid 110 is an actuator for moving a plunger 112 in a receding direction with respect to a solenoid body 111 when magnetized, and is attached via the solenoid body 111 to the under surface of a solenoid support part 99 provided to the bracket body 90. More specifically, it is attached to the solenoid support part 99 of the bracket body 90 via the solenoid body 111 with the tip part of the plunger 112 being directed to the spring holding part 85 of the stopper plate 80 and with the axis of the plunger 112 being directed in the longitudinal direction of the stopper plate 80. The spring holding part 85 of the stopper plate 80 is connected to the tip part of the plunger 112 via a turn buckle 113.

When the electromagnetic solenoid 110 is demagnetized, the plunger 112 is kept pulled apart from the solenoid body 111 by the above described tension spring 100. On the other hand, when the electromagnetic solenoid 110 is magnetized, the plunger 112 can be pulled into the solenoid body 111 against the tension force of the tension spring 100.

In the loading and unloading operation unit 1, when the operator is not on the driver seat (not illustrated), the electromagnetic solenoid 110 is kept demagnetized. Under the state where the electromagnetic solenoid 110 is demagnetized, the plunger 112 of the electromagnetic solenoid 110 is pulled apart from the solenoid body 111 by the tension spring 100, and the engagement parts 83 provided to the stopper plate 80 are kept engaged in the engagement shaft parts 71 of the engagement members 70, respectively (engaged position) as illustrated in FIG. 6-1. When the engagement shaft parts 71 of the engagement members 70 are engaged in the engagement parts 83 of the stopper plate 80, the contact end surfaces 72*b* and 73*b* of the engagement member 70 come into contact with the stopper plate 80, respectively, which prevents the movement of the engagement members 70 along their axis direction with respect to the stopper plate 80.

As described above, because disposed between the reference plate 91 and the guide plates 92 and 93 of the bracket body 90, the stopper plate 80 cannot move in the plate thickness direction, that is, in the axis direction of the engagement members 70. As a result, in the state where the operator is not on the driver seat, all the movements of the link members 60 in the vertical direction can be prevented by the cooperation of the engagement members 70 and the stopper plate 80. Thus, even if the external force is applied to the operation parts 12 of the operation levers 10, the hydraulic control valves 20 will not operate and therefore the position or the state of the fork will not change.

On the other hand, in response that the operator sits on the driver seat, the electromagnetic solenoid 110 is magnetized by the command from a not-illustrated main controller, and the plunger 112 is pulled into the solenoid body 111 against the tension force of the tension spring 100 (released position), as illustrated in FIG. 6-2. In this state, the engagement parts 83 of the stopper plate 80 move apart from the engagement shaft parts 71 of the engagement members 70 and are positioned at the releasing notches 82, and the stopper plate 80 deviates from between the contact end surfaces 72*b* and 73*b* of the engagement members 70. Therefore, the rotating operation of the operation part 12 of the operation lever 10 around the axis 40*a* of the support shaft member 40 causes the engagement base parts 72 and 73 of the engagement member 70 to enter the releasing notch 82 allowing the link member 60 to properly move in the vertical direction, which allows for the switching operation of the hydraulic control valve 20 via the valve input part 22.

Further, in response that the operator leaves the driver seat, the electromagnetic solenoid 110 is demagnetized by the command from the main controller (not illustrated), the plunger 112 of the electromagnetic solenoid 110 is pulled out by the tension spring 100 returning to the state as illustrated in FIG. 6-1 (engaged position). Thereby, the engagement parts 83 provided to the stopper plate 80 engage in the engagement shaft parts 71 of the engagement members 70, respectively, and all the movements of the link members 60 along the vertical direction are prevented, so that the position or the state of the fork does not move unintentionally and the current state can be maintained.

At this time, even if the position of the engagement shaft part 71 is misaligned to the front, rear, left or right, the engagement shaft part 71 can be guided into the engagement part 83 by the function of the inclined guide surface 84 provided to the opening of the engagement part 83. Further, when the position of the engagement shaft part 71 is misaligned to the upper or under, the stopper plate 80 will come into contact with the taper parts 72*a* and 73*a* of the engagement member 70, so that the engagement shaft part 71 can be guided into the engagement part 83 by the inclining function of the taper parts 72*a* and 73*a*.

Thus, according to the forklift comprising the loading and unloading operation unit 1 as described above, when the operator is not on the driver seat, the operation of the hydraulic control valves 20 can be prevented by causing the stopper plate 80 to engage in the engagement members 70, so that it is not likely to cause the situation where the position or the state of the fork is unintentionally changed. Furthermore, since the stopper plate 80 common to a plurality of engagement members 70 is employed, an increase in the number of parts can be suppressed.

Furthermore, the operation levers 10 and the hydraulic control valves 20 are connected by the link members 60 and, in the link members 60, the engagement members 70 are provided to the portion lower than the floor panel FL, so that it is not required to arrange any parts around the dashboard 50 and thus a good forward visibility can be ensured.

It is noted that, in the embodiment as described above, the stopper plate 80, the electromagnetic solenoid 110, and the tension spring 100 are supported by the shared bracket body 90 to make a unit, and this unit is supported by the unit support 30. Therefore, for the stopper plate 80, the electromagnetic solenoid 110, and the tension spring 100, the assembly operation can be easier by implementing in advance the positioning among them. Further, the positioning with the engagement members 70 provided to the link members 60 can be made by adjusting the position of the bracket body 90 with respect to the unit support 30, so that this operation can be also done easily. In the present invention, however, the electromagnetic solenoid 110 and the tension spring 100 are not necessarily required to be provided to the bracket body 90 and may be directly provided to the unit support 30.

Further, although the embodiment as described above has exemplified the relatively large forklift that comprises five operation levers 10 and five hydraulic control valves 20, the number of the operation levers 10 and the hydraulic control valves 20 is not limited to five.

Furthermore, although the embodiment as described above is configured to cause the engagement parts 83 of the stopper plate 80 to engage in the engagement members 70 by the tension spring 100 when the electromagnetic solenoid 110 is demagnetized, the opposite manner will be possible. Further, although the tension spring 100 is employed as the bias means, it is possible to configure so as to cause the engagement parts 83 of the stopper plate 80 to engage in the engagement members 70 by the pressing. It is noted that, as the actuator, it is not always necessary to employ the electromagnetic solenoid 110, and other actuator such as a cylinder, for example, may be employed. Also as the stopper member, it is not always necessary to employ the plate-like one, the member of any shape can be employed as long as being able to engage in the engagement members 70 to restrict the movement thereof.

REFERENCE SIGNS LIST

10 operation lever
11 operation base part
12 operation part
13 output part
20 hydraulic control valve
21 valve body
22 valve input part
22 each valve input part
30 unit support
31 support member
40 support shaft member
40*a* axis
50 dashboard
60 link member
70 engagement member
71 engagement shaft part
72, 73 engagement base part
72*a*, 73*a* taper part
72*b*, 73*b* contact end surface
80 stopper plate
82 releasing notch
83 engagement part
90 bracket body
100 tension spring
110 electromagnetic solenoid
FL floor panel

The invention claimed is:

1. An operation lever lock apparatus applied to a forklift, the apparatus comprising:

a plurality of operation levers arranged rotatably with respect to a common lever rotation axis which is provided in a position covered with a dashboard and is arranged in a lateral direction of a vehicle;

a plurality of hydraulic control valves which are arranged at a portion lower than a floor panel in a front part of the vehicle and are arranged in parallel in the lateral direction, the plurality of hydraulic control valves having valve input parts on upper surfaces of the hydraulic control valves, respectively; and a plurality of link members, each of the plurality of link members extending downward from an operation base part of a corresponding one of the operation levers to be connected to a corresponding one of the valve input parts, wherein the hydraulic control valves are operated via the valve input parts by causing the link members to move vertically via operation parts of the operation levers, the apparatus further comprising:

an engagement member provided under the link member; and a stopper member having an engagement part to be engaged in the engagement member, wherein the stopper member is movable between an engaged position at which the engagement part engages in the engagement member and a released position at which the engagement part is released from the engagement member, and arranged to restrict movement of the link member in a vertical direction when positioned in the engaged position, and the engagement part is open to one side of edges of the stopper member in the lateral direction of the vehicle with a releasing notch, and an actuator is supported by a bracket body in which the stopper member is movably arranged and a bias member to always bias the stopper member towards the engaged position is arranged between the bracket body and the stopper member such that the stopper member, the bracket body, the actuator, and the bias member are unitized, and the stopper member, the bracket body, the actuator, and the bias member which are unitized are supported by a unit support supporting the operation levers and the hydraulic control valves and are attached to the vehicle via the unit support.

2. The operation lever lock apparatus according to claim 1, wherein the stopper member has a plate-like shape and has a plurality of the engagement parts that, when positioned in the engaged position, engage in a plurality of the engagement members, respectively, to restrict movements of the link members in the vertical direction.

3. The operation lever lock apparatus according to claim 1, wherein the engagement member has an engagement shaft part having a size that allows the engagement part of the stopper member to engage therein, and large diameter engagement base parts respectively provided at upper and lower ends of the engagement shaft part and, when the stopper member is positioned in the engaged position, movement of the link member in the vertical direction is restricted by causing two contact end surfaces each of which is formed between the engagement shaft part and the engagement base part to come into contact with the stopper member.

4. The operation lever lock apparatus according to claim 3, wherein each of the engagement base parts of the engagement member has a taper part whose outer diameter gradually decreases as approaching the engagement shaft part.

5. The operation lever lock apparatus according to claim 1, wherein a pair of inclined guide surfaces is formed adjacent to the engagement part with a distance between each other gradually increases as a distance from the engagement part increases.

6. The operation lever lock apparatus according to claim 1, wherein a bias direction of the bias member is the lateral direction of the vehicle.

* * * * *